US007191625B2

(12) United States Patent
Yahagi et al.

(10) Patent No.: US 7,191,625 B2
(45) Date of Patent: Mar. 20, 2007

(54) METHOD OF CLEANING AN ALUMINUM DRUM SUBSTRATE FOR AN ELECTROPHOTOGRAPHIC PHOTOCONDUCTOR

(75) Inventors: Hidetaka Yahagi, Nagano (JP); Shuji Hatakeyama, Nagano (JP)

(73) Assignee: Fuji Electric Device Technology Co., Ltd., Tokyo (JP)

( * ) Notice: Subject to any disclaimer, the term of this patent is extended or adjusted under 35 U.S.C. 154(b) by 104 days.

(21) Appl. No.: 11/180,914

(22) Filed: Jul. 14, 2005

(65) Prior Publication Data

US 2006/0010950 A1 Jan. 19, 2006

(30) Foreign Application Priority Data

Jul. 15, 2004 (JP) ..... 2004-209160

(51) Int. Cl.
*B21C 43/02* (2006.01)

(52) U.S. Cl. ..... 72/39; 239/751

(58) Field of Classification Search ..... 72/39, 72/40; 134/172, 176, 179, 180, 198; 239/750, 239/751, 227, 597
See application file for complete search history.

(56) References Cited

U.S. PATENT DOCUMENTS 3,955,588 A * 5/1976 Born ..... 134/129
5,221,297 A * 6/1993 Childress et al. ..... 95/75
6,585,829 B1 * 7/2003 Suzuki et al. ..... 134/19

FOREIGN PATENT DOCUMENTS

| | | |
|---|---|---|
| JP | 05-285461 | 11/1993 |
| JP | 08-253883 | 10/1996 |
| JP | 3421279 | 4/2003 |
| JP | 2003-262964 | 9/2003 |

* cited by examiner

*Primary Examiner*—Lowell A. Larson
*Assistant Examiner*—Debra Wolfe
(74) *Attorney, Agent, or Firm*—Rabin & Berdo, PC

(57) ABSTRACT

A method of cleaning an aluminum drum substrate that removes cutting chips, and degreases to remove high viscosity drawing oil used in a cold drawing process, without using a chlorine-containing organic solvent. A plurality of aluminum drum substrates are arranged in rows, with an axis of each drum substrate being vertical and parallel with the axis of the other drum substrates. A cleaning liquid is ejected at a predetermined ejection pressure from a high-pressure cleaning nozzle. The cleaning liquid is ejected in a fan shape having a predetermined spread angle and from above a top opening of one of the drum substrates towards the drum substrate. While ejecting the cleaning liquid, the nozzle is horizontally and sequentially traversed above openings of the other drum substrates in a direction of the row, while swinging the nozzle in the direction of the row.

14 Claims, 5 Drawing Sheets

METHOD OF CLEANING AN ALUMINUM DRUM SUBSTRATE FOR AN ELECTROPHOTOGRAPHIC PHOTOCONDUCTOR

CROSS-REFERENCE TO RELATED APPLICATION

This application is based on, and claims priority to, Japanese Application No. 2004-209160, filed on Jul. 15, 2004, the contents of which are incorporated herein by reference.

BACKGROUND OF THE INVENTION

1. Field of the Invention

Image formation devices are known which are used to form fine images. The image formation device includes an electrophotographic photoconductor having a photosensitive layer which is formed on an outer surface of an aluminum drum substrate. To manufacture the aluminum drum substrate, an aluminum ingot is subjected to hot extrusion and cold drawing processes to form a cylindrical tube. The cylindrical tube is then cut to obtain an aluminum raw drum having a predetermined length. Further machining operations are then performed to obtain the aluminum drum substrate having precise dimensions and a specified surface condition. The invention relates to a method of cleaning the aluminum raw drum, after the cold drawing process and cutting of the cylindrical tube to the predetermined length, in the manufacturing process of an aluminum drum substrate.

2. Description of the Related Art

The technology of electrophotography has been developed in the field of copying machines, and recently, has been applied to laser printers and the like. A known image formation device, which forms an image using an electrophotographic process, includes an electrophotographic photoconductor. The electrophotographic photoconductor includes an aluminum drum substrate, and a photosensitive or photoconductive layer, which coats an outer surface of the aluminum drum substrate.

The outer surface and other essential surfaces of the drum substrate have very precise dimensions and specified surface conditions, which are formed in a cutting operation. In the following description, when distinguishing between the aluminum drum substrate before and after finishing to the very precise dimensions and specified surface conditions, the former, that is a drum substrate before the finishing, will be referred to as a raw drum (or an aluminum raw drum).

According to a common method of manufacturing an aluminum raw drum, the raw drum is formed from an aluminum ingot, using the following procedures: melting, adjustment of composition, filtration of insoluble impurities, casting, and homogenizing treatment. The ingot is subjected to a hot extrusion process to form a tube shape, followed by a cold drawing process in which the tube shape is drawn to a specified thickness, to thereby form a cylindrical tube or drum having a specified diameter and thickness. Cutting to a specified length (for example, 240 to 360 mm) and cleaning is then performed.

The above cold drawing process uses drawing oil that exhibits a very high viscosity (kinetic viscosity of 1,000 to 2,000 cSt: centistokes, 1 cSt=$10^{-6}$ $m^2/s$), for example, polybutylene. The drawing oil causes a large amount of cutting chips, which are created in the cutting step, to adhere to the outer and inner surfaces of the raw drum. Thus, the raw drum must be cleaned to remove the oil and cutting chips. In the conventional cleaning process, which follows the cutting to a specified length, the drawing oil is removed (degreased) using a chlorine-containing organic solvent, such as dichloromethane or trichloroethylene, that exhibits a very high solubility of the drawing oil.

Recently, the restriction of organic solvents, particularly chlorine-containing organic solvents, has been intensified to reduce the adverse effects to the natural environment. As an alternative solvent, using alkali detergents or the like has been proposed. For example, in Japanese Unexamined Patent Application Publication No. 2003-262964, a method of cleaning an aluminum tube for photoconductors has been disclosed, in which degreasing cleaning is performed using alkaline ionic water with a pH value of 10 to 12 at a liquid temperature of 40 to 60° C., while being subjected to ultrasonic vibration. In Japanese Patent No. 3421279, a cleaning method is discussed in which the cutting chips and the cutting oil that adhere to the inner surface of the drum are removed using a jet of high pressure water, and without using a chlorine-containing organic solvent. The water is ejected, at an ejection pressure in a range of $1.47\times10^7$ Pa to $1.96\times10^7$ Pa, from an ejection nozzle towards the inner surface, while moving the nozzle up and down inside the drum.

The nozzle is moved in a longitudinal direction inside the drum. When only one nozzle is used to treat many raw drums, working time is increased, resulting in poor production. When the number of nozzles used is increased to equal to the number of raw drums, production efficiency is increased, but the equipment becomes complicated. Further, in the case of a large number of nozzles, water consumption becomes a limiting factor, since water flow per nozzle and per unit time is high. Further, when cleaning using a single nozzle, the cleaned portion may become discolored when using certain types of cleaning liquid, due to the increased time required to remove the cutting chips and the drawing oil.

Moreover, if the cutting chips are not completely eliminated, and remain on the inside surface of the raw drum, the cutting chips will be pinched together. Since the inside surface is a reference of centering and is held in the subsequent cutting operation, a center of rotation may be shifted during the cutting, resulting in a deterioration in the concentricity between the inside surface and the outside surface of the worked drum. Accordingly, Japanese (Unexamined Patent Application Publication No. 2003-262964 proposes an additional pre-cleaning process using a shower of tap water before the degreasing step using the alkaline ionic water. However, the tap water shower is insufficient to effectively remove the adhered cutting chips.

Further, the cleaning effect using ultrasonic vibration varies depending on a distance from an ultrasound transducer and on the location condition. For example, if an area to be cleaned is at a back side or in a shadow with reference to the transducer, such as when removing cutting chips from the inner surface of a drum, the cleaning effect is apt to decay and sufficient cleaning is not accomplished.

SUMMARY OF THE INVENTION

In view of the above problems, an object of the invention is to provide a method of cleaning an aluminum drum substrate of an electrophotographic photoconductor. The method efficiently removes and degreases a large amount of cutting chips and high viscosity drawing oil without using a chlorine-containing organic solvent. The cutting chips are generated in a cutting step after a cold drawing step, and the drawing oil is used in the cold drawing step in the process of manufacturing a raw drum, which will be fabricated into an aluminum drum substrate for an electrophotographic photoconductor. The chips and oil are adhered on an outside surface and inside surface of the raw drum.

According to one aspect of the invention, a plurality of aluminum drum substrates are arranged in rows with each axis of the drum substrate being vertical and parallel with each other, after cold drawing and cutting to a predetermined length. High pressure cleaning liquid at a predetermined ejection pressure is ejected from a high pressure cleaning nozzle, in a fan shape with a predetermined spread angle, from above a top opening of one of the drum substrates towards the drum substrate. The nozzle horizontally traverses sequentially above openings of other drum substrates in a direction of the row, while swinging the nozzle in the direction of the row.

According to another aspect of the invention, advantageously, the relation of a Formula 1 in the method of cleaning a drum substrate, is as follows:

$$h \geqq \Phi/(2 \tan(\theta/2)), \quad \text{[Formula 1]}$$

where $\Phi$ is a diameter of the drum substrate, $\theta$ is the spread angle of the cleaning liquid ejected from the high pressure cleaning nozzle, and h is a distance between the top of the drum substrate and a nozzle hole.

In a further aspect of the invention, a process of warm pure water drying is conducted after the cleaning.

In another aspect of the invention, the cleaning liquid is an alkaline cleaning liquid or an alkaline electrolytic solution exhibiting a pH value in a range of 8 to 12, and high pressure cleaning is conducted at an ejection pressure in a range of $4.9\times10^6$ Pa to $2.94\times10^7$ Pa.

In yet another aspect of the invention, the high pressure cleaning liquid is pure water, and high pressure cleaning is conducted at an ejection pressure in a range of $1.96\times10^7$ Pa to $2.94\times10^7$ Pa.

According to a further aspect of the invention, the high pressure cleaning liquid is pressurized and supplied by a high pressure plunger pump connected through a piping to the high pressure cleaning nozzle.

According to a further aspect of the invention, the cleaning is carried out with one of the high pressure cleaning nozzles traversing in forward and backward directions along two rows of the plurality of drum substrates.

According to another aspect of the invention, the cleaning is carried out with the high pressure cleaning nozzle traversing in forward and backward directions along the rows at a velocity in a range of 3 mm/s to 8 mm/s.

According to a further aspect of the invention, an angle of swing motion of the nozzle is in a range of 15 degrees to 25 degrees.

The method according to the invention will be described in detail in the following with reference to the accompanying drawings. The invention shall not be limited to the embodiment described below, but can be modified within the spirit and scope of the invention.

DESCRIPTION OF SYMBOLS

Figure 1:
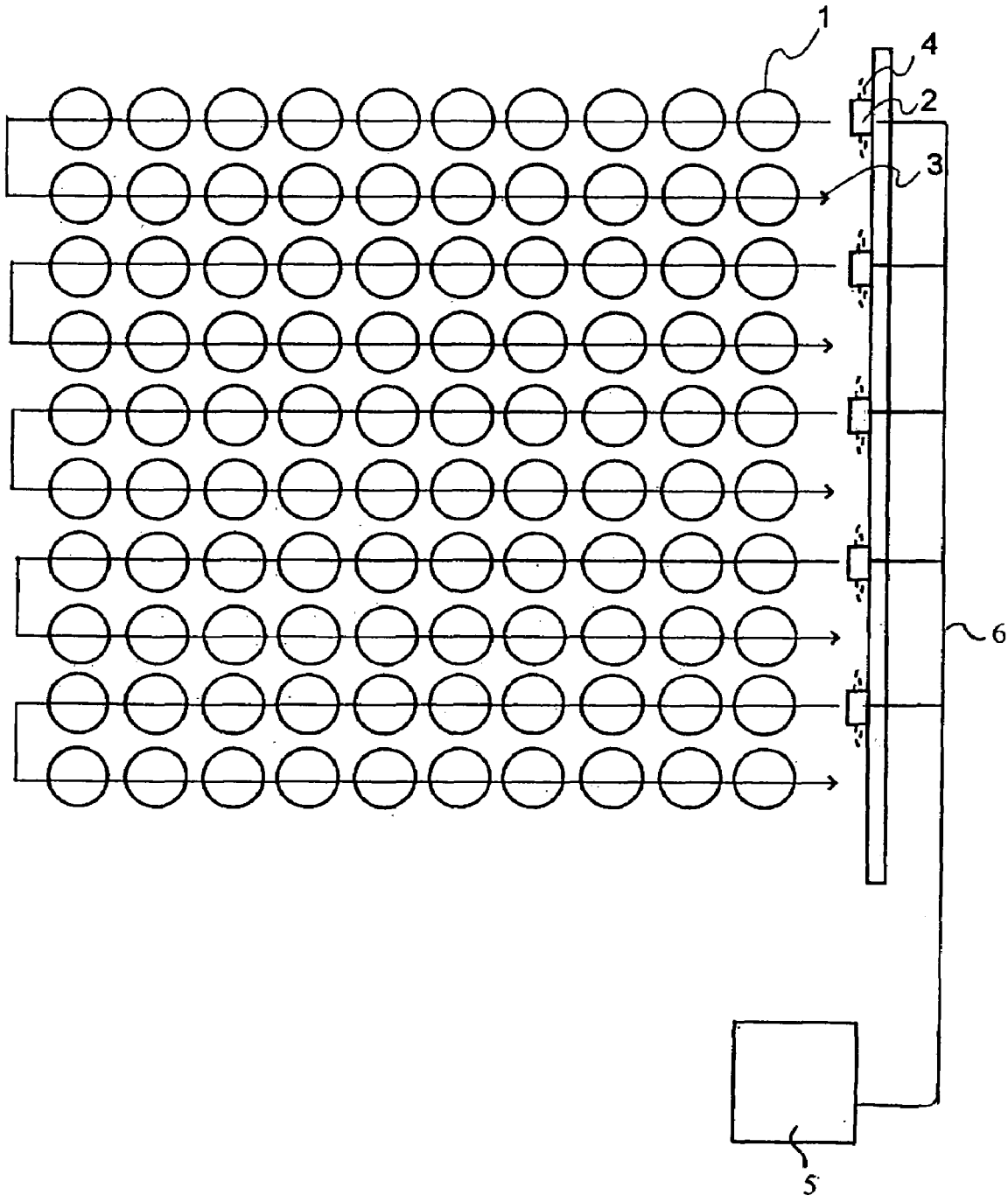
FIG. 1 is a schematic plan view illustrating the cleaning of a plurality of aluminum drum substrates, according to the invention.

1 drum substrate
2 high-pressure nozzle
3 direction of movement of the high-pressure nozzle
4 spread of ejected cleaning liquid
5 plunger pump
6 piping
b angle of swing motion
$\theta$ spread of angle of ejected cleaning liquid
$\Phi$ diameter of a drum substrate
h distance between a top of a drum substrate and a nozzle hole

DETAILED DESCRIPTION OF THE INVENTION

The invention is directed to a method of cleaning an aluminum drum substrate, also hereinafter referred to as a raw drum. Prior to the cleaning, a hot extruded tube of aluminum, having a composition specified in JIS (Japanese Industrial Standards) of A6063 (an Si—Mg aluminum alloy), is cold drawn using drawing oil, such as polybutene. The drawing oil has a high viscosity, for example, 1,500 cSt. The cold drawing causes the aluminum cylindrical tube to have, for example, an outer diameter of 30 mm and an inner diameter of 28.5 mm. Then, the aluminum cylindrical tube is cut to a length of about 360 mm to obtain an aluminum raw drum. After the cutting, a large amount of cutting chips and drawing oil will be adhered on an inside and outside surface of the raw drum. The following describes a method for removing the cutting chips and the high viscosity drawing oil from the inside and outside surfaces of the raw drums.

As shown in FIG. 1, a plurality of aluminum drum substrates 1 having an outer diameter of 30 mm, and to which cutting chips and high viscosity drawing oil are adhered, are arranged in 10 rows and 10 columns, with the axes of the drums being disposed in a vertical direction. A support frame (not shown in the figure) is fitted to the drum substrates 1 to prevent the drums from falling when subjected to the high pressure cleaning liquid. Alternatively, the drum substrates 1 can be inserted into a prepared frame to be arranged in 10 rows and 10 columns. The frame preferably has a shape that will not damage the substrates and not obstruct the cleaning. A total exemplary length of a row of the aluminum drum substrates 1 is about 450 mm along a direction of movement of the high pressure cleaning nozzle 2.

A high pressure nozzle 2 is provided for every two rows at an end of a respective row, and at a position near and above a top of the drum substrates 1, for example, about 10 cm above the top of the substrates. The position of the high pressure nozzle above the drum substrates is determined by a Formula 1, where $\Phi$ is a diameter of the drum substrate, $\theta$ is a spread angle of the cleaning liquid ejected from the high pressure cleaning nozzle, and h is a distance between the top of the drum substrate and a nozzle hole.

$$h \geqq \Phi/(2 \tan(\theta/2)). \quad \text{[Formula 1]}$$

For example, providing a spread angle θ of 25 degrees and a drum substrate diameter Φ of 30 mm, results in a distance h between the top of the drum substrate and the nozzle hole (i.e., the height of the high-pressure nozzle) of at least 67.7 mm. The height of the high-pressure nozzle is thus preferably at least 67.7 mm, but was rounded up to 100 mm (10 cm) in this embodiment. This height is effective for a drum substrate having a length between 240 mm to 370 mm. The cleaning effect does not vary along a longitudinal direction of the drum substrate having this range of length, so that the drum substrate is cleaned uniformly from its top to its bottom.

In this embodiment, the ejection of the high pressure cleaning liquid was conducted by a high-pressure jet apparatus using a high pressure plunger pump manufactured by Maruyama Excell Co., Ltd. The cleaning liquid is pressurized by the high-pressure plunger pump 5 (shown only schematically in the figures) and ejected from the high-pressure nozzle 2 towards the drum substrate 1. The high-pressure nozzle 2 is connected to the plunger pump 5 through piping 6. The cleaning liquid is pure water or an alkaline cleaning liquid at a liquid temperature of 50° C. The alkaline cleaning liquid was either an alkaline cleaning agent (Castrol No. 450, manufactured by BP Castrol K.K.) or an alkaline electrolytic solution at a hydrogen ion exponent (pH) of 11.5. The cleaning liquid is ejected at a liquid flow rate of 8 L/min in a direction approximately perpendicular to the traversing direction of the nozzle, and with a spread angle θ of 25 degrees. The high-pressure nozzle 2 is horizontally moved at a velocity of 5 mm/s in the direction indicated by the arrow 3 in FIG. 1. The alkaline electrolytic solution is a cleaning liquid obtained by electrolysis of a potassium carbonate solution. The spread angle θ (25 degrees in this example) may be varied, for a fixed position of the high-pressure nozzle from the top of the substrate, depending on the inner diameter of the drum substrate, so that the cleaning liquid uniformly strikes the inner surface of the drum substrate. The alkaline cleaning liquid is known to have a superior cleaning effect for high viscosity drawing oil than a cleaning liquid of pure water. Nevertheless, an alkaline cleaning liquid having a hydrogen ion exponent (pH) larger than 12 has such a strong etching effect on the aluminum drum substrate, that discoloration may occur on an inner surface of the substrate, due to the generation of an aluminum hydrate (boehmite). Therefore, the hydrogen ion exponent is preferably no greater than 12. On the other hand, a hydrogen ion exponent (pH) less than 8.0 results in essentially the same cleaning effect as pure water.

The high-pressure nozzle 2 moves in a forward path, and above the drum substrates 1 in the direction of the arrow 3 at a velocity of 5 mm/s while cleaning. When a row is cleaned, the nozzle goes to the next row and returns in a reverse path while cleaning. A high-pressure nozzle 2 is provided for every two rows. For an arrangement of 10 rows and 10 columns (i.e., 100 drum substrates), five nozzles are provided. The five nozzles begin their cleaning simultaneously, and can clean the 100 drum substrates in 3 minutes; thus, this procedure is very efficient. The traversing velocity of the high-pressure nozzles is selected to be from 3 mm/s to 8 mm/s, depending on an inner diameter and length of the drum substrate, and with consideration of operation efficiency. A traversing velocity slower than 3 mm/s can cause poor operation efficiency, while a traversing velocity faster than 8 mm/s adversely affects the cleaning effect. For a drum substrate having an inner diameter of 28.5 mm and a length of 360 mm, the optimum traversing velocity is 5 mm/s. After the cutting chips and the high viscosity drawing oil adhered on the drum substrates are removed using the high pressure cleaning nozzles, the drum substrates are preferably immersed in a warm pure water bath at a temperature in a range of 60° C. to 80° C., and dried with hot air.

Figure 2:
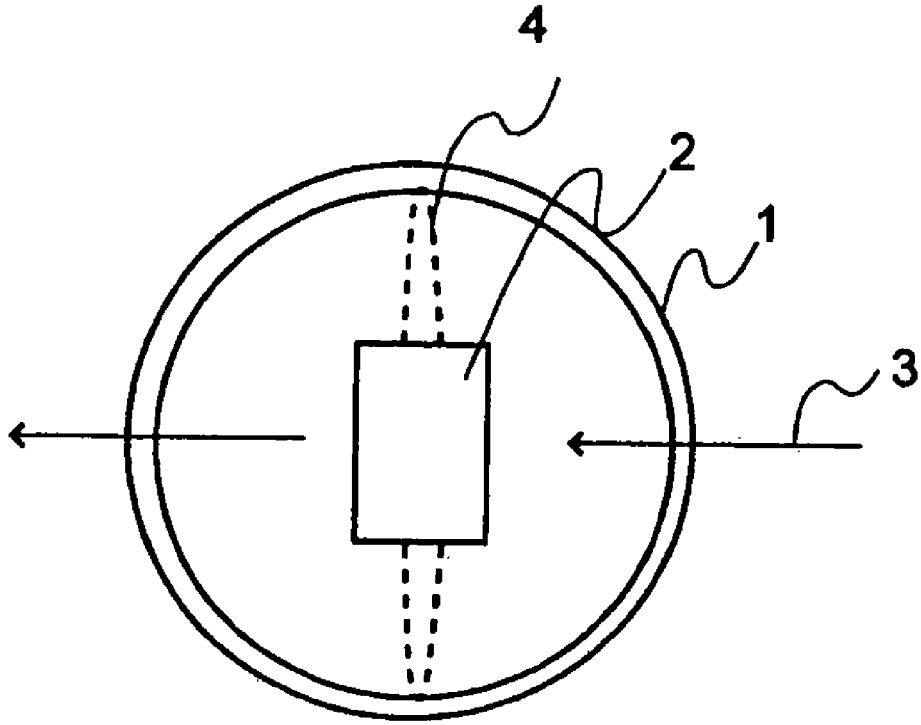
FIG. 2 is a plan view illustrating the cleaning of one drum substrate by a high-pressure nozzle, according to the invention.
Figure 3:
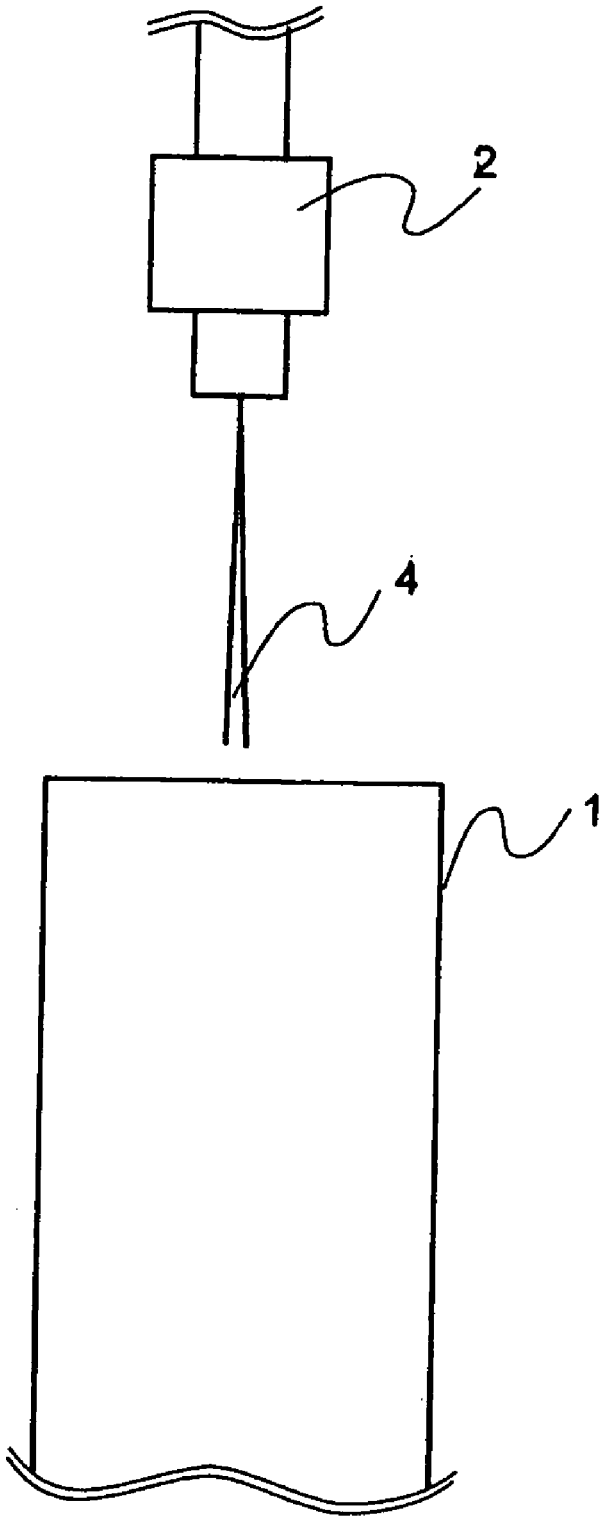
FIG. 3 is a side view illustrating the cleaning of the drum substrate by the high-pressure nozzle, according to the invention.
Figure 4:
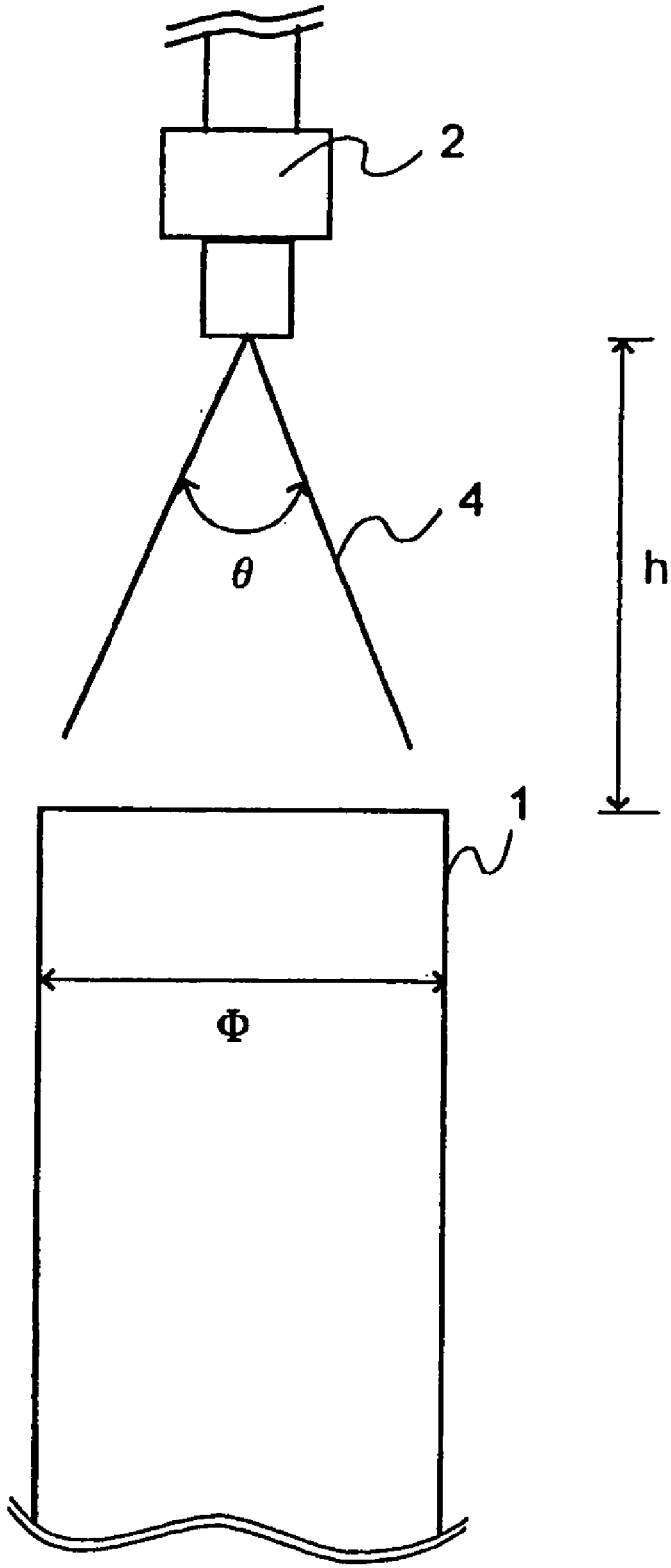
FIG. 4 is a front view illustrating the cleaning of the drum substrate by the high pressure nozzle, according to the invention.
Figure 5:
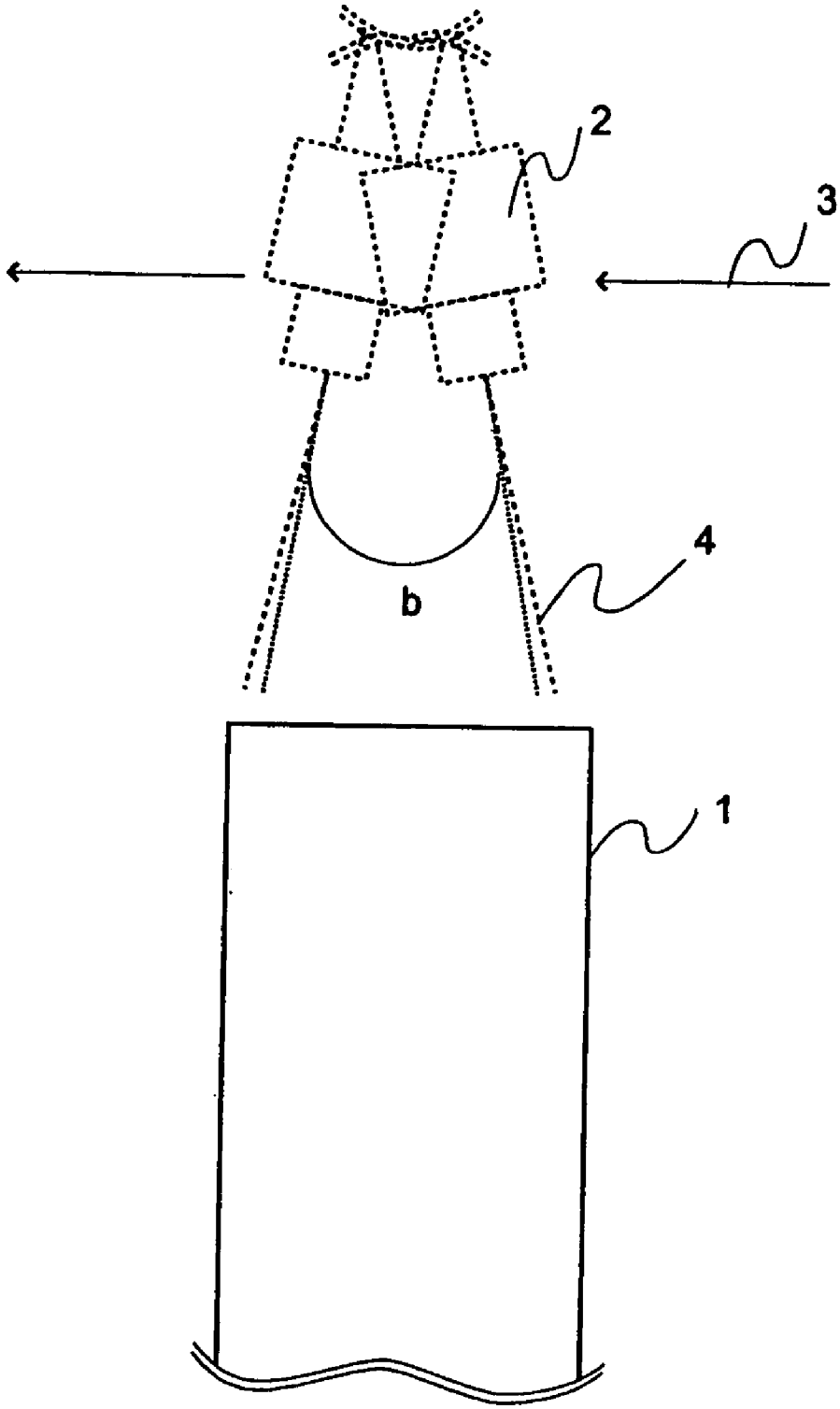
FIG. 5 is a side view illustrating the high-pressure nozzle of FIG. 4, swinging in a horizontal direction.

FIG. 2 is a partial enlarged plan view of FIG. 1, showing one drum substrate being cleaned. The high-pressure nozzle 2 is located above the drum substrate 1. The cleaning liquid 4, shown by the dotted lines, is ejected from the bottom of the high-pressure nozzle 2 to the inside of the drum substrate 1 with a spread angle θ. The arrow 3 indicates the direction of movement of the high-pressure nozzle 2. Although FIG. 2 shows that the traversing direction 3 of the high-pressure nozzle 2 intersects with the spread of the cleaning liquid 4 at a right angle, the angle of intersection preferably deviates slightly from a right angle, so as to be nearly a right angle. The high-pressure nozzle 2 is preferably adjusted so that the traversing direction 3 and the vertical direction intersects with the spread of the cleaning liquid 4 at nearly a right angle. By adjusting all of the parallel-arranged high-pressure nozzles 2 in this way, the cleaning liquid ejected from the nozzles will not interfere with each other, so that efficient cleaning is performed. FIG. 3 is a side view corresponding to FIG. 2, seen from a direction perpendicular to the arrow 3. FIG. 4 is a front view corresponding to FIG. 2, seen from a direction parallel to the arrow 3. FIG. 4 shows that the cleaning liquid is ejected at a preferable spread angle θ of 25 degrees. Comparing FIG. 3 and FIG. 4, the ejected cleaning liquid can be seen to spread only in a direction approximately perpendicular to the traversing direction of the high pressure nozzle 2. FIG. 5 is a side view seen from a direction perpendicular to the arrow 3, and shows the swing motion of the high-pressure nozzle. The dotted lines indicate the extreme positions of the swinging high-pressure nozzle 2. The symbol b indicates an angle of the swing motion. The angle of swing motion b is preferably in a range of 15 degrees to 25 degrees. An angle smaller than 15 degrees increases a portion of the cleaning liquid that does not strike the substrate and which will instead pass wastefully through the inside of the substrate, thus diminishing the cleaning efficiency. An angle larger than 25 degrees will increase a portion of the cleaning liquid that is ejected outside the substrate, thus also diminishing the cleaning efficiency. The arrow 3 in FIG. 5 indicates the traversing direction of the high-pressure nozzle 2.

EXPERIMENTAL EXAMPLE 1

A cleaning effect was studied on a method of cleaning an aluminum drum substrate having a diameter and length, and composed of a material specified by JIS-A6063, as described previously. Pure water was used as the high pressure cleaning liquid. The ejection pressures of the pure water were 50, 70, 100, 200, and 300 kgf/cm$^2$ (corresponding to 0.49, 0.686, 0.98, 1.96, and $2.94\times10^7$ Pa, respectively.) The height of the high-pressure nozzle h was about 100 mm, and the spread angle of the cleaning liquid was 25 degrees. With an aluminum drum substrate having a thickness of 0.75 mm, an ejection pressure over 500 kgf/cm$^2$ (corresponding to $4.9\times10^7$ Pa) could cause deformation. Of course, a higher ejection pressure can be used with an aluminum drum substrate having a greater thickness.

EXPERIMENTAL EXAMPLE 2

A cleaning effect was studied at various ejection pressures in the same manner as in Experimental Example 1, except that the high pressure cleaning liquid of pure water was replaced by an alkaline cleaning agent (Castrol No. 450, manufactured by BP Castrol K.K.) that was diluted to 2% (hydrogen ion exponent 9.0).

EXPERIMENTAL EXAMPLE 3

A cleaning effect was studied at various ejection pressures in the same manner as in Experimental Example 1, except that the high pressure cleaning liquid of pure water was replaced by a liquid exhibiting a hydrogen ion exponent (pH) of 11.5, using an alkaline electrolytic solution generated from potassium carbonate.

EXPERIMENTAL EXAMPLE 4

A cleaning effect was studied using pure water in the same manner as in Experimental Example 1, except that the ejection pressures were 20 kgf/cm$^2$ (corresponding to $1.96\times10^6$ Pa) and 40 kgf/cm$^2$ (corresponding to $3.92\times10^6$ Pa).

EXPERIMENTAL EXAMPLE 5

A cleaning effect was studied using an alkaline cleaning agent (Castrol No. 450, manufactured by BP Castrol K.K.) that was diluted to 2% (hydrogen ion exponent 9.0) in the same manner as in Experimental Example 2, except that the ejection pressures were 20 kgf/cm$^2$ (corresponding to $1.96\times10^6$ Pa) and 40 kgf/cm$^2$ (corresponding to $3.92\times10^6$ Pa).

EXPERIMENTAL EXAMPLE 6

A cleaning effect was studied using a cleaning liquid exhibiting a hydrogen ion exponent (pH) of 11.5, using an alkaline electrolytic solution generated from potassium carbonate in the same manner as in Experimental Example 3, except that the ejection pressures were 20 kgf/cm$^2$ (corresponding to $1.96\times10^6$ Pa) and 40 kgf/cm$^2$ (corresponding to $3.92\times10^6$ Pa).

As an evaluation of the cleaning effects in the above Experimental Examples, a visual inspection for the adhered cutting chips was conducted. The results are shown in Table 1, where ◎ indicates the cutting chips were completely removed, ○ indicates the cutting chips were almost completely removed, Δ indicates the cutting chips were partly remaining, and X indicates the cutting chips were hardly removed.

A degreasing effect was evaluated by wettability using 20% black ink.

The results are shown in Table 2, where

◎ indicates the whole surface was subject to wetting,

○ indicates 90% of the whole surface was subject to wetting,

Δ indicates 70 to 90% of the whole surface was subject to wetting, and

X indicates less than 70% of the whole surface was subject to wetting.

TABLE 1

| Removal of cutting chips | ejection pressure (kgf/cm$^2$) | | | | | | |
|---|---|---|---|---|---|---|---|
| | 20 | 40 | 50 | 70 | 100 | 200 | 300 |
| Experimental Example 1 | — | — | ○ | ◎ | ◎ | ◎ | ◎ |
| Experimental Example 2 | — | — | ◎ | ◎ | ◎ | ◎ | ◎ |
| Experimental Example 3 | — | — | ◎ | ◎ | ◎ | ◎ | ◎ |

TABLE 1-continued

| Removal of cutting chips | ejection pressure (kgf/cm$^2$) | | | | | | |
|---|---|---|---|---|---|---|---|
| | 20 | 40 | 50 | 70 | 100 | 200 | 300 |
| Experimental Example 4 | X | Δ | — | — | — | — | — |
| Experimental Example 5 | Δ | Δ | — | — | — | — | — |
| Experimental Example 6 | Δ | Δ | — | — | — | — | — |

TABLE 2

| Degreasing effect | ejection pressure (kgf/cm$^2$) | | | | | | |
|---|---|---|---|---|---|---|---|
| | 20 | 40 | 50 | 70 | 100 | 200 | 300 |
| Experimental Example 1 | — | — | Δ | Δ | Δ | ○ | ◎ |
| Experimental Example 2 | — | — | ○ | ○ | ◎ | ◎ | ◎ |
| Experimental Example 3 | — | — | ○ | ○ | ◎ | ◎ | ◎ |
| Experimental Example 4 | X | X | — | — | — | — | — |
| Experimental Example 5 | X | X | — | — | — | — | — |
| Experimental Example 6 | X | X | — | — | — | — | — |

As indicated in Table 1, Experimental Examples 1, 2, and 3 show that the cutting chips are almost completely removed at any ejection pressure in the range of 50 kgf/cm$^2$ to 300 kgf/cm$^2$ (corresponding to $4.9\times10^6$ Pa to $2.94\times10^7$ Pa) using either pure water or the alkaline cleaning liquid as the cleaning fluid. On the other hand, Experimental Examples 4, 5, and 6 show that a portion of the cutting chips remains at the ejection pressures of 20 kgf/cm$^2$ (corresponding to $1.96\times10^6$ Pa) and 40 kgf/cm$^2$ (corresponding to $3.92\times10^6$ Pa) using either the pure water or the alkaline cleaning liquid, though some degree of cleaning effect was observed. The ejection pressures of 20 kgf/cm$^2$ and 40 kgf/cm$^2$ are lower than a preferred value of the invention.

As indicated in Table 2, Experimental Example 1 shows that when using a cleaning liquid of pure water, 90% of the whole surface was subject to wetting, indicating an almost complete degreasing at an ejection pressure in the range of 200 kgf/cm$^2$ to 300 kgf/cm$^2$ (corresponding to $1.96\times10^7$ Pa to $2.94\times10^7$ Pa). Experimental Examples 2 and 3 show that when using the alkaline cleaning liquid, 90% of the whole surface was subject to wetting, indicating an almost complete degreasing at any ejection pressure in the range of 50 kgf/cm$^2$ to 300 kgf/cm$^2$ (corresponding to $4.9\times10^6$ Pa to $2.94\times10^7$ Pa).

On the other hand, when using either pure water (Experimental Example 4) or the alkaline cleaning liquid (Experimental Examples 5 and 6) as the cleaning fluid, the proportion of the wetted area with black ink was below 70%, indicating an insufficient degreasing at a low ejection pressure of 20 kgf/cm$^2$ (corresponding to $1.96\times10^6$ Pa) and 40 kgf/cm$^2$ (corresponding to $3.92\times10^6$ Pa).

What is claimed is:

1. A method of cleaning an aluminum drum substrate for an electrophotographic photoconductor, comprising:

forming a plurality of aluminum drum substrates using cold drawing and cutting operations;

after said forming, arranging the plurality of aluminum drum substrates in rows, with an axis of each drum substrate being vertical and parallel with the axis of the other drum substrates;

ejecting a cleaning liquid at a predetermined ejection pressure from a high pressure cleaning nozzle, the cleaning liquid being ejected in a fan shape having a predetermined spread angle and from above a top opening of one of the drum substrates towards the drum substrate; and while ejecting the cleaning liquid, horizontally and sequentially traversing the nozzle above openings of the other drum substrates in a direction of the row, while swinging the nozzle in the direction of the row.

2. The method of cleaning an aluminum drum substrate according to claim 1, wherein $$h \geqq \Phi(2 \tan(\theta/2)),$$

where $\Phi$ is a diameter of the drum substrate, $\theta$ is the spread angle of the cleaning liquid, and h is a distance between a top of the drum substrate and a nozzle hole.

3. The method of cleaning an aluminum drum substrate according to claim 1, further comprising immersing, after said traversing, the drum substrates in a warm pure water bath, and drying the drum substrates with hot air.

4. The method of cleaning an aluminum drum substrate according to claim 2, wherein the cleaning liquid is one of an alkaline cleaning agent or an alkaline electrolytic solution exhibiting a pH value in a range of 8 to 12, and wherein the ejection pressure is in a range of $4.9\times10^6$ Pa to $2.94\times10^7$ Pa.

5. The method of cleaning an aluminum drum substrate according to claim 2, wherein the cleaning liquid is pure water, and wherein the ejection pressure is in a range of $1.96\times10^7$ Pa to $2.94\times10^7$ Pa.

6. The method of cleaning an aluminum drum substrate according to claim 4, wherein the cleaning liquid is pressurized and supplied using a high pressure plunger pump connected through piping to the cleaning nozzle.

7. The method of cleaning an aluminum drum substrate according to claim 1, wherein the traversing includes traversing the nozzle in a first direction, above the openings of the drum substrates of a first row, and subsequently traversing the nozzle in a second direction that is opposite to the first direction, above the openings of the drum substrates of a second row.

8. The method of cleaning an aluminum drum substrate according to claim 4, wherein the traversing includes traversing the nozzle in forward and backward directions along the rows at a velocity in a range of 3 mm/s to 8 mm/s.

9. The method of cleaning an aluminum drum substrate according to claim 8, wherein the nozzle is swung with an angle of swing motion in a range of 15 degrees to 25 degrees.

10. The method of cleaning an aluminum drum substrate according to claim 2, further comprising immersing, after said traversing, the drum substrates in a warm pure water bath, and drying the drum substrates with hot air.

11. The method of cleaning an aluminum drum substrate according to claim 5, wherein the cleaning liquid is pressurized and supplied using a high pressure plunger pump connected through piping to the cleaning nozzle.

12. The method of cleaning an aluminum drum substrate according to claim 2, wherein the nozzle is traversed in a first direction, above the openings of the drum substrates of a first row, and subsequently traversed in a second direction that is opposite to the first direction, above the openings of the drum substrates of a second row.

13. The method of cleaning an aluminum drum substrate according to claim 5, wherein the traversing includes traversing the nozzle in forward and backward directions along the rows at a velocity in a range of 3 mm/s to 8 mm/s.

14. The method of cleaning an aluminum drum substrate according to claim 13, wherein the nozzle is swung with an angle of swing motion in a range of 15 degrees to 25 degrees.

* * * * *

UNITED STATES PATENT AND TRADEMARK OFFICE

CERTIFICATE OF CORRECTION

PATENT NO. : 7,191,625 B2
APPLICATION NO. : 11/180914
DATED : March 20, 2007
INVENTOR(S) : Hidetaka Yahagi and Shuji Hatakeyama It is certified that error appears in the above-identified patent and that said Letters Patent is hereby corrected as shown below:

IN CLAIM 2:
Column 9, line 13: change "$h \geqq \Phi (2 \tan (\theta/2))$," to --$h \geqq \Phi /(2 \tan (\theta/2))$,--

Signed and Sealed this

Twenty-second Day of May, 2007

JON W. DUDAS
*Director of the United States Patent and Trademark Office*